US005224463A

United States Patent [19]

Townsend

[11] Patent Number: 5,224,463

[45] Date of Patent: Jul. 6, 1993

[54] BOWSTRING RELEASE ASSEMBLY

[75] Inventor: Robert R. Townsend, Lancaster, Ky.

[73] Assignee: Flatiron Development, Inc., Lancaster, Ky.

[21] Appl. No.: 852,037

[22] Filed: Mar. 16, 1992

[51] Int. Cl.[5] ..... F41B 5/00

[52] U.S. Cl. ..... 124/35.2; 124/31

[58] Field of Search ..... 124/35.1, 35.2, 40, 124/31, 37

[56] References Cited

U.S. PATENT DOCUMENTS

| | | | |
|---|---|---|---|
| 2,982,279 | 5/1961 | Pursley | 124/35.1 |
| 3,026,864 | 3/1962 | Gray | 124/37 X |
| 3,952,720 | 4/1976 | Wilson | 124/35.2 |
| 4,308,851 | 1/1982 | Kaine, Jr. et al. | 124/35.2 |
| 4,316,443 | 2/1982 | Giacomo | 124/35.2 |
| 4,392,475 | 7/1983 | Fletcher | 124/35.2 |
| 5,027,786 | 7/1991 | Peck | 124/35.2 |

*Primary Examiner*—Randolph A. Reese

*Assistant Examiner*—Anthony Knight

*Attorney, Agent, or Firm*—King and Schickli

[57] ABSTRACT

A bowstring release assembly comprises a housing that receives the operative components that facilitate bowstring release motion. A gear assembly initiates and actuates the release motion. A rack and a pinion form the gear assembly. A trigger operates the rack to translate within the housing. The pinion is formed on a first portion of the peripheral surface of a rotary member which rotates in response to operation of the rack. A cam is formed on a second portion of the peripheral surface of the rotary member. The cam cooperates with a roller disposed on one end of a restraint assembly mounted on a pivot pin within the housing to allow bowstring release. A peg disposed on a second end of the restraint assembly engages the bowstring for restraint and pivots away upon actuation for release. A rope loop anchored to the housing may be provided to wrap around the bowstring and hook onto the peg for restraint.

18 Claims, 2 Drawing Sheets

BOWSTRING RELEASE ASSEMBLY

TECHNICAL FIELD

The present invention relates generally to archery equipment and, more particularly, to a bowstring release assembly that provides control and consistency in the release of a bowstring.

BACKGROUND OF THE INVENTION

The flight path of an arrow is influenced by many factors. Some factors, such as air currents, cannot be controlled by the archer. The major influences, however, on arrow trajectory are the physical actions of the archer. Accordingly, it is important for an archer to command the physically controllable factors to facilitate consistency and accuracy.

The draw and release of the bowstring play an important part in defining the flight path of the arrow. After the arrow is nocked to the bowstring, the archer pulls the bowstring to a drawn position in preparation for firing. This places the bowstring in considerable tension. The archer then releases the bowstring by relaxing his grip. The bowstring is energized and responds by advancing instantaneously from the drawn position. This firing action propels the arrow. While this technique may be mastered for consistency through repetition, it can be appreciated that slight unintended and unnoticed adjustments or twitches during the release motion can significantly alter the desired trajectory of the arrow.

Various bowstring release devices have been developed in order to normalize the release motion. The mechanics of these devices is intended to provide uniformity and consistency from use to use.

Many prior art bowstring release devices utilize a trigger mechanism that is actuated by the archer. U.S. Pat. No. 3,937,206 to Wilson discloses a bowstring release device having a pivotable trigger mechanism that initiates the bowstring release mode. A rope loop is attached to the housing of the release device and extends around the bowstring for engagement. The rope loop is hooked in a notch formed in a release wheel to hold the bowstring as it is drawn. A sear block bears against the release wheel and is held against movement by a trigger block, thus holding the release wheel in position for drawing the bowstring. When the archer pulls the trigger lever on the trigger block, the trigger block pivots to disengage from the sear block. The sear block is no longer able to hold the release wheel which rotates to allow release of the bowstring.

U.S. Pat. No. 4,860,720 to Todd discloses a bowstring release device with a pivotable trigger that operates to extend and retract a sleeve mounted on the housing. A pair of ball bearings are mounted in the housing on opposing sides of a slot that receives the bowstring. When the sleeve is in the extended position, the ball bearings are pressed firmly together and restrain the bowstring in the slot. The sleeve retracts when the trigger is pulled, allowing the ball bearings to separate and release the bowstring.

Even though the prior art designs have provided more consistency in the release of the bowstring, they still have disadvantages. More particularly, since bowstring release devices are exposed to tremendous force in restraining the bowstring in the fully drawn position, they are subject to significant wear with use over time. As a result, the trigger must be continuously adjusted in order to maintain consistent operation. In addition, component wear introduces the opportunity for jerkiness in release motion. This substantially reduces the advantage of consistent bowstring release for which the device was designed. In extreme cases, the release device may fail, creating a hazardous situation.

Accordingly, there remains a need to provide an improved bowstring release assembly that functions with precision for its intended purpose. The device should not require constant adjustment in order to maintain uniform operation. In addition, the bowstring release assembly should have a long service life. Thus, the assembly should be formed of durable components while being of simple design.

SUMMARY OF THE INVENTION

Accordingly, it is a primary object of the present invention to provide a bowstring release assembly that facilitates the consistent release of a drawn bowstring.

It is another object of the present invention to provide a bowstring release assembly that is durable and has a long service life.

Still another object of the present invention is to provide a bowstring release assembly that is of compact construction for easy handling when not in use.

Another object of the present invention is to provide a bowstring release assembly with a trigger mechanism that allows smooth and easy actuation during the release mode.

It is a further object of the present invention to provide a bowstring release assembly that improves firing accuracy by substantially eliminating extraneous movement by the archer to release the bowstring.

Still another object of the present invention is to provide a bowstring release assembly that is easy and economical to manufacture.

It is an additional object of the present invention to provide a bowstring release assembly that is capable of retaining a drawn bowstring under substantial tension in recurrent use without the need for constant adjustment.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved bowstring release assembly is provided. The assembly includes a housing that is of compact construction to facilitate ease in handling. The housing supports the operating components of the bowstring release assembly.

The assembly includes means cooperating with the housing for engaging the bowstring for restraint and release. Preferably, the engaging means is a restraint assembly that cooperates with other components of the bowstring release assembly for operative use. A rope loop may be anchored to the housing and used to engage and restrain the bowstring during the drawing motion. While the rope loop is advantageously used to facilitate operation, the release assembly may be used with the bowstring directly engaging the restraint assembly.

In an important aspect of the invention, a gear assembly is provided for actuating the engaging means to release the bowstring. It is well-known that gears efficiently transmit motion in a variety of operational settings. They offer precision and uniformity and thus provide a significant mechanical advantage in their working environment. It can thus be appreciated that the novel use of a gear assembly to actuate the release of the drawn bowstring furnishes superior consistency as compared with prior art designs.

In the preferred embodiment, the gear assembly comprises a rack and a pinion. A trigger cooperates with the rack to initiate the release mode of the bowstring. When the trigger is in its cocked position, the bowstring release assembly is in the restraint mode, holding the bowstring in the drawn position. The trigger translates with the rack as it is pulled by the archer from its cocked position to initiate release motion. With this design, the trigger does not pivot about a fixed point to act as a lever as in most prior art designs.

The preferred embodiment contemplates the trigger being formed integral with the rack. With this arrangement, the force required to actuate bowstring release is easily generated and efficiently transmitted.

The pinion is formed on a first portion of the peripheral surface of a rotary member held within the housing. More specifically, gear teeth are formed on a portion of the rotary member. The rotary member is positioned within the housing so that the teeth of the pinion are disposed in mating engagement with the teeth of the rack.

A cam is provided on a second portion of the peripheral surface of the rotary member. The cam is designed with a profile that cooperates with a cam follower to actuate release of the bowstring as the rotary member rotates in response to the initiating action of the trigger.

The cam follower is a roller that is disposed on a first end of a restraint assembly. A peg that projects from the housing comprises a second end of the restraint assembly. The restraint assembly is mounted on a pin substantially centered between the roller and the peg. This mounting arrangement allows the restraint assembly to pivot between a restraint position and a release position. In the restraint position, the peg operates to hold the bowstring during drawing motion and maintains the bowstring in its fully drawn position. As the archer pulls the trigger to initiate the release mode, the peg remains in the restraint position until the roller engages the cam surface of the rotary member. At this instant, the peg pivots to the release position, thereby releasing the bowstring.

The structural cooperation of the components of the bowstring release assembly defines a unique functional approach to addressing the disadvantages of prior art designs. More particularly, as broadly defined, the assembly includes means for initiating through translational motion the release of the bowstring. There is further provided means responsive to the translational initiating means for actuating the engaging means. The preferred embodiment of the invention contemplates that the actuating means operates through rotary motion to act upon the engaging means.

From the description above, it can be appreciated that the initiating means and the actuating means in this structural combination include the gear assembly. Furthermore, in the preferred embodiment described above, the initiating means comprises the trigger cooperating with the rack and the actuating means comprises the pinion.

The bowstring release assembly also includes an adjustment screw that is received within the housing and extends through a bore in the rack. The screw is operated to adjust the sensitivity of the trigger as desired. A return spring cooperates with and acts to bias the rack with the associated trigger to its cocked position. The housing also receives an anchor screw that attaches a wrist strap to the assembly. The wrist strap may be secured around the wrist to stabilize the bowstring release assembly during operative use.

In operation, the release assembly is set in the restraint mode, with the trigger in the cocked position and the restraint assembly locked in the restraint position. With the bowstring held by the peg, it is drawn to its firing position. When ready to fire, the archer initiates the release mode by pulling the trigger.

As the archer pulls the trigger, the rack translates within the housing. As a result of the mating engagement between the teeth of the rack and the teeth of the pinion, the rotary member is caused to rotate. The cam surface of the rotary member engages the roller of the restraint assembly at which time the roller looses restraining contact. At this instant, the tension of the bowstring is unopposed, allowing the bowstring to overcome the resistance offered by the peg of the restraint assembly. As the peg rotates about the pin from the restraining position to the release position, the bowstring is released to propel the arrow.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
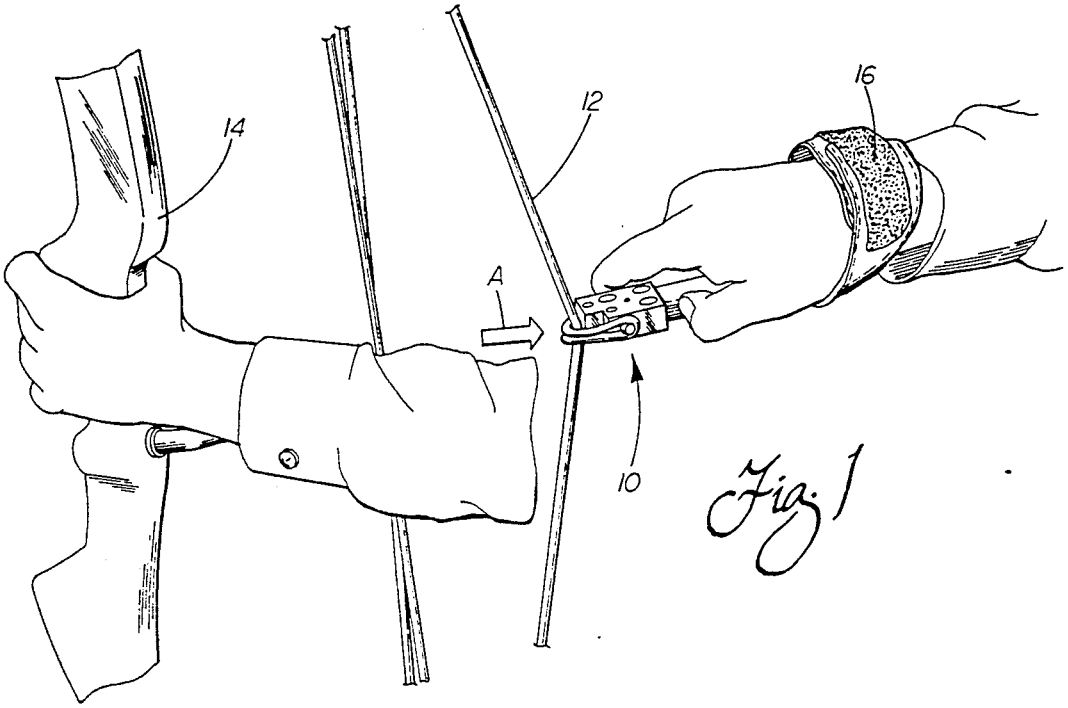
FIG. 1 is a perspective view of the bowstring release assembly of the present invention in operative use by an archer.

A preferred embodiment of the bowstring release assembly 10 according to the teachings of the present invention is shown in operative use in FIG. 1 of the drawing. The inventive bowstring release assembly 10 provides consistent and uniform release motion during repeated use. Furthermore, the improved assembly 10 is compact and durable and thus has a long service life.

In use, the bowstring release assembly 10 engages the bowstring 12 of a bow 14 as it is drawn in preparation for launching an arrow (not shown). The archer firmly grasps the bow 14 with the appropriate hand while the other hand draws the bowstring 12 for firing as described by action arrow A. The drawing hand holds the bowstring release assembly 10 to functionally cooperate with the bowstring 12.

For a right-handed compound bow 14 as shown in FIG. 1, the left-hand grasps the bow and the right hand pulls the bowstring 12 with the release assembly 10. The hand positions are reversed for left-handed compound bows. While the bowstring release assembly 10 is illustrated in use with a compound bow, the assembly functions effectively with other types of bows.

It is important that the bowstring release assembly 10 is firmly held by the archer to take full advantage of its functional operation. To assist in stabilizing the release assembly 10 during operative use, it is mounted to a wrist strap 16 as is generally known in the art. The wrist strap 16 typically has cooperating bands that ar secured together with a buckle assembly and/or a hook-and-loop fastener. The wrist strap 16 is attached to the bowstring release assembly 10 with a connector, such as an anchor screw 18. The anchor screw 18 is shown covered with a sleeve 19 in FIGS. 1 and 2. The anchor screw is threadedly received in screw čavity 17 (see FIG. 3–5).

Preferably, the wrist strap 16 is rotatably mounted to the bowstring release assembly 10. This allows the relative orientation to be reversed so that the assembly accommodates use with both right-handed and left-handed bows. The wrist strap 16 is wrapped around and secured to the archer's wrist in preparation for operative use. The wrist strap 16 not only enhances the consistent operation of the release assembly 10 but also secures it against loss or misplacement when not in use. This is particularly important when the archer is engaged in hunting activities in densely wooded areas.

The bowstring release assembly 10 includes a housing 20 that receives the operational components. These components broadly include means 22 for engaging the bowstring for restraint and release. There is further included means 24 for initiating the release mode of the assembly 10. Finally, there is included means, in the form of a gear assembly 28, for actuating the engaging means 22 to release the bowstring 12 in response to the initiating means 24.

The gear assembly 28 that functions to initiate and actuate the bowstring release motion. Gears have long been used to transmit motion generated by driving elements to driven elements. They have proven their functional value in many severe applications such as automobile transmissions and industrial machinery. When manufactured according to exact specifications, they offer operational precision through conjugate action and stand up to tremendous loads over extended periods of continuous use. Accordingly, it can be appreciated that the use of the gear assembly 28 in the inventive bowstring release assembly 10 provides superior consistency and improved uniform motion transmission as compared with known designs.

Figure 3:
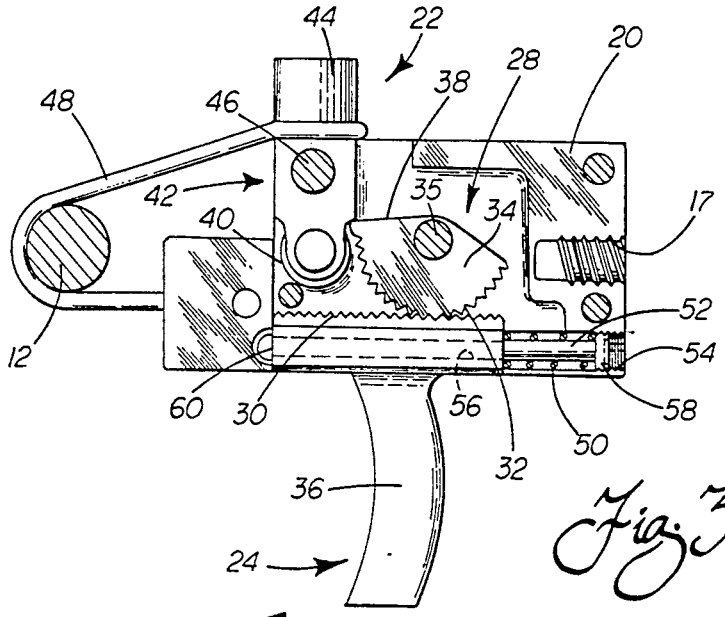
FIG. 3 is a cross-sectional view of the bowstring release assembly of the present invention showing the interaction of the components of the preferred embodiment in the restraint position.
Figure 4:
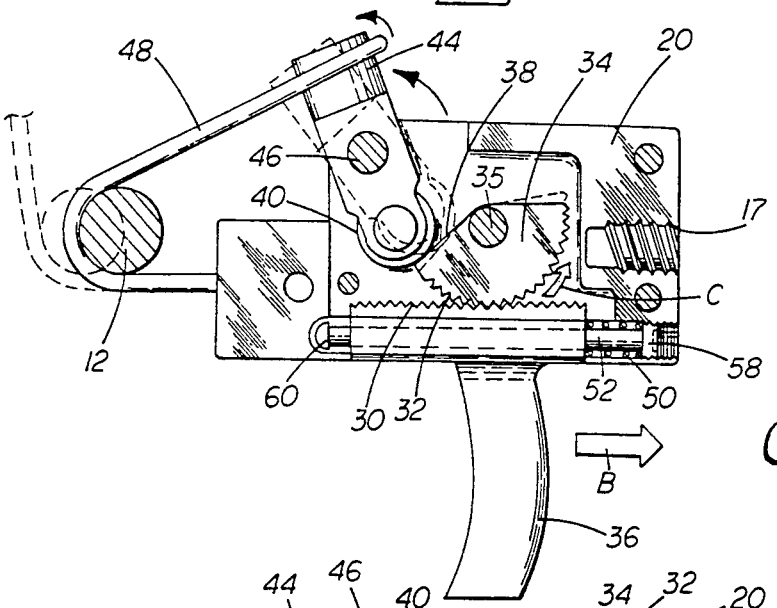
FIG. 4 is a cross-sectional view of the bowstring release assembly of the present invention showing the interaction of the components of the preferred embodiment during the transition from the restraint position to the release position.
Figure 5:
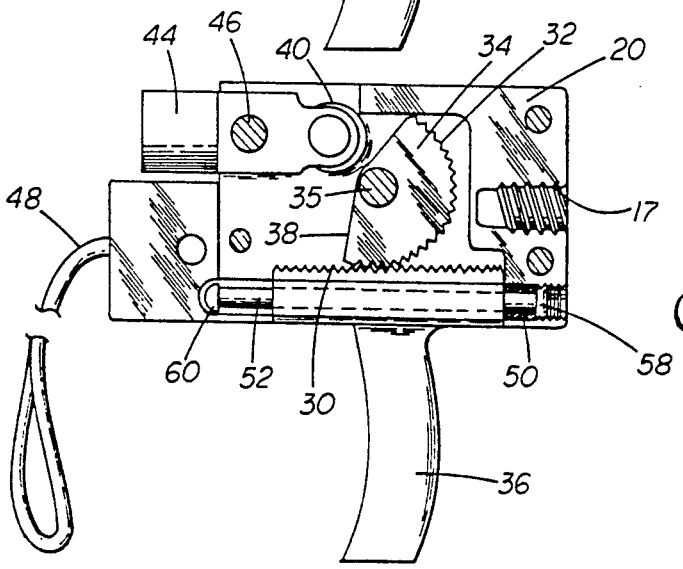
FIG. 5 is a cross-sectional view of the bowstring release assembly of the present invention showing the interaction of the components of the preferred embodiment in the release position.

As best shown in FIGS. 3–5, the gear assembly 28 preferably takes the form of a rack 30 that meshes with a pinion 32. The rack 30 is disposed for translational movement within the housing 20. The pinion 32 is formed on a first portion of the peripheral surface of a rotary member 34 mounted in the housing on a pivot pin 35.

The rack 30 and pinion 32 are relatively positioned within the housing 20 to allow cooperative meshing engagement between their respective teeth. Thus, efficient mechanical action occurs and uniform motion transmission results during operative use. Accordingly, the translation of the rack 30 (see action arrow B in FIG. 4) causes the pinion 32 and thus the rotary member 34 to rotate as indicated by action arrow C.

The bowstring release assembly 10 further includes a trigger 36 that cooperates with the rack 30 and is pulled by the archer (see FIG. 1 where the trigger is engaged by the index finger) to initiate the release mode. The trigger 36 translates in concert with the rack 30 as it initiates the release mode. Thus the trigger 36 does not pivot about a fixed point in operation as with most prior art bowstring release triggers. This advantageously improves the uniformity of trigger action and smooths overall operation for more accurate shooting.

In the preferred embodiment, the trigger 36 is formed integral with the rack 30. The unitary construction provides a significantly stronger trigger mechanism as compared with prior art releases. Thus the opportunity for material wear failure is substantially reduced. In addition, the invention provides greater efficiency in the generation and transmission of release motion.

The rotary member 34 further includes a cam 38 on a second portion of its peripheral surface. The rotary member 34 thus serves as the actuating means and responds to the initiation of the release mode by the trigger 36. The cam 38 of the rotary member 34 is formed with a profile that cooperates with a cam follower to actuate the release of the bowstring 12 during the release mode as is more fully described below.

The cam follower is preferably a roller 40 disposed on one end of a pivotable restraint assembly 42. It can be appreciated from the following description that the restraint assembly 42 broadly comprises the engaging means 22 for the bowstring release assembly 10.

Engagement of the bowstring 12 is effected by a peg 44 disposed on a second end of the restraint assembly 42. The peg 44 projects from the housing 20 and acts to restrain the bowstring 12 when in its restraint position as the bowstring is drawn and held for firing.

The restraint assembly 42 is mounted on a pivot pin 46 to secure the assembly to the housing 20. The pin 46 is substantially centered between the peg 44 and the roller 40. Thus, in operation, as the release mode is initiated, the roller 40 engages the cam surface 38 of the rotating rotary member 34. As this occurs, the peg 44 pivots away to allow the bowstring 12 to be released for firing.

As shown in the drawing, the bowstring release assembly 10 preferably includes a rope loop 48 that directly engages the bowstring 12 as it is drawn. The rope loop 48 is anchored to the housing 20 by a securing means such as rivet 49 (see FIG. 2) and is wrapped around the bowstring 12 prior to the drawing motion. The rope loop 48 is then hooked to the peg 44. With the peg 44 securely held in the restraint position by the rotary number 34, the bowstring 12 is drawn with the release assembly 10 to the firing position. While the use of the rope loop 48 is most beneficial to the operation of the bowstring release assembly 10, the assembly may be used with direct engagement between the peg 44 and the bowstring 12 if desired.

A return spring 50 is provided to bias the trigger 36 to the cocked position corresponding to the restraint position of the restraint assembly 42. Thus, following the present firing cycle, the peg 44 is pivoted to the restraint position in preparation for the succeeding firing cycle. The return spring 50 urges the rack 30 forward and, through the cooperation of the pinion 32, rotates the rotary member 34 in the direction opposite to that occurring during actuation. In the restraint position, the roller 40 is held against relative travel by the rotary member 34 (see FIG. 3). This locks the restraint assembly 42 in the restraint position until the trigger 36 is pulled from the cocked position.

Advantageously, an adjustment screw 52 is provided to adjust the trigger force required to effect bowstring release motion. The screw 52 is received in an aperture 54 in the housing 20 and passes through a bore 56 formed in the rack 30 (see FIGS. 3-5). The screw 52 includes an operable head 58 at a proximal end and a stop shoulder 60 at a distal end. The stop shoulder 60 abuts the edge of the rack 30 when the trigger 36 is in the cocked position. By manipulating the head 58 of the adjustment screw 52 with the appropriate operating tool (e.g. screwdriver), the longitudinal position of the stop shoulder 60 is adjusted. As a result, the cocked position of the trigger is changed. Thus, the trigger stroke required to cause the release of the bowstring 12 may be adjusted. Accordingly, the adjustment of the screw 52 alters the sensitivity of the bowstring release assembly 10 as desired.

The operation of the firing cycle utilizing the inventive bowstring release assembly 10 will now be described. The release assembly 10 is secured to the archers hand with the wrist strap 16. As stated above, the peg 44 is pivoted to the restraint position and the return spring 50 biases the trigger 36 to the cocked position. The rope loop 48 is wrapped around the bowstring 12 and hooked over the peg 44. The hand holding the release assembly 10 is retracted, drawing the bowstring 12 to the firing position.

It can be appreciated that the tension in the drawn bowstring 12 creates a tremendous force on the peg 44. The bowstring 12 seeks to alleviate the tension through the release motion. However, uninitiated release is prevented due to the resistance force created by the stationary engagement of the roller 40 with the edge of the rotary member 34. Thus, the release of the bowstring 12 and firing of an arrow is under the strict control of the trigger 36.

Figure 2:
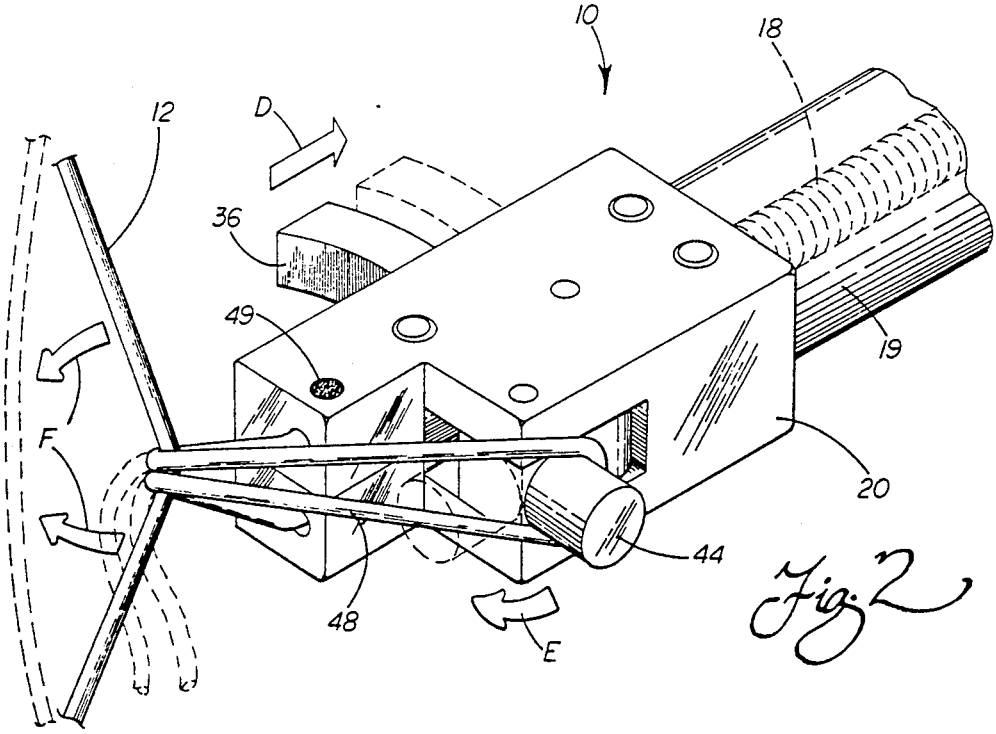
FIG. 2 is an enlarged view of the bowstring release assembly of the present invention in the position as shown in FIG. 1, with the restraint position shown in full line and the release position shown in phantom line.

With particular reference to FIG. 2, when ready to fire, the archer grasps the trigger 36 and pulls to initiate the release mode as shown by action arrow D. The rack 30 translates in response to manipulation of the trigger 36. This drives the pinion 32 and thus the rotary member 34 to rotate. As the rotary member 34 rotates, its cam surface 38 is presented for engagement with the roller 40. At this instant, the stored energy of the tensed bowstring 12 is released, forcing the peg 44 to pivot away from the restraint position (see action arrow E) to release the bowstring 12 for firing action according to action arrow F.

In summary, numerous benefits result from employing the concepts of the present invention. Advantageously, the gear assembly 28 provides significant mechanical advantage for consistent and uniform release of the bowstring 12. The translational capability of the rack 30 provides smooth motion as the archer pulls the trigger 36 to initiate bowstring release. The rotary member 34 upon which the pinion 32 is formed rotates in response to the translational motion of the cooperating rack 30. The roller 40 of the restraint assembly 42 cooperates with the cam surface 38 of the rotary member 34 to actuate bowstring release. The components cooperate efficiently to offer a well-balanced, reliable and durable bowstring release assembly 10.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A bowstring release assembly, comprising:

a housing;

means cooperating with said housing for engaging a bowstring for restraint and release; and a gear assembly, including a rack and a pinion, for initiating and actuating said engaging means to release said whereby uniform and consistent bowstring release motion is provided during recurrent use.

2. The bowstring release assembly as in claim 1, wherein is included a trigger cooperating with said rack to initiate the actuating motion of said release assembly.

3. The bowstring release assembly as in claim 1, wherein said pinion is formed on a first portion of the peripheral surface of a rotary member.

4. The bowstring release assembly as in claim 3, wherein a cam is formed on a second portion of the peripheral surface of said rotary member.

5. The bowstring release assembly as in claim 4, wherein said engaging means comprises a restraint assembly that cooperates with said gear assembly.

6. The bowstring release assembly as in claim 5, wherein said engaging means further includes a rope loop anchored to said housing and cooperating with said restraint assembly to restrain and release said bowstring.

7. The bowstring release assembly as in claim 5, wherein said restraint assembly comprises a roller disposed on a proximal end to cooperate with said cam and a peg disposed on a distal end for restraining said bowstring.

8. The bowstring release assembly as in claim 7, wherein said restraint assembly is mounted on a pin to allow said peg to pivot from a restraint position to a release position as said roller moves in response to operative engagement with said cam.

9. The bowstring release assembly as in claim 1, wherein said engaging means comprises a restraint assembly that cooperates with said gear assembly.

10. The bowstring release assembly as in claim 9, wherein said engaging means further includes a rope loop anchored to said housing, said rope loop cooperating with said restraining assembly to restrain and release said bowstring.

11. A bowstring release assembly, comprising:

a housing;

means cooperating with said housing for engaging a bowstring for restraint and release;

means for initiating through translational motion the release of said bowstring; and means responsive to said initiating means for actuating said engaging means to release said bowstring;- said initiating means including a trigger cooperating with a rack and said actuating means including a pinion whereby uniform and consistent bowstring release motion is provided during recurrent use.

12. The bowstring release assembly as in claim 11, wherein said actuating means operates through rotary motion to actuate said engaging means.

13. The bowstring release assembly as in claim 11, wherein said initiating means and said actuating means comprise a gear assembly.

14. The bowstring release assembly as in claim 11, wherein said pinion is formed on a first portion of the peripheral surface of a rotary member.

15. The bowstring release assembly as in claim 14, where a cam is formed on a second portion of the peripheral surface of said rotary member.

16. The bowstring release assembly of claim 15, wherein said engaging means comprises a restraint assembly that cooperates with said cam.

17. The bowstring release assembly of claim 16, wherein said restraint assembly comprises a roller disposed on a proximal end to cooperate with said cam and a peg disposed on a distal end for restraining said bowstring.

18. The bowstring release assembly of claim 17, wherein said restraint assembly is mounted on a pin to allow said peg to pivot from a restraint position to a release position as said roller moves in response to operative engagement with said cam.

* * * * *